US011747002B1

(12) United States Patent
Xu

(10) Patent No.: US 11,747,002 B1
(45) Date of Patent: Sep. 5, 2023

(54) STRING LIGHT, CONNECTION CABLE AND LIGHT COVER

(71) Applicant: Shenzhen Leshida Lighting Co., Ltd., Shenzhen (CN)

(72) Inventor: Xiaojun Xu, Shenzhen (CN)

(73) Assignee: SHENZHEN LESHIDA LIGHTING CO., LTD., Shenzhen (CN)

( * ) Notice: Subject to any disclaimer, the term of this patent is extended or adjusted under 35 U.S.C. 154(b) by 0 days.

(21) Appl. No.: 17/900,879

(22) Filed: Sep. 1, 2022

(30) Foreign Application Priority Data

Jul. 15, 2022 (CN) ..... CN202210837729

(51) Int. Cl.
*F21V 23/00* (2015.01)
*F21V 3/00* (2015.01)
*F21S 4/10* (2016.01)
*F21Y 115/10* (2016.01)

(52) U.S. Cl.
CPC ..... *F21V 23/001* (2013.01); *F21S 4/10* (2016.01); *F21V 3/00* (2013.01); *F21Y 2115/10* (2016.08)

(58) Field of Classification Search
CPC ..... F21V 23/001; F21V 3/00; F21S 4/10
See application file for complete search history.

(56) References Cited

U.S. PATENT DOCUMENTS 6,343,870 B1 * 2/2002 Chang ..... F21S 4/10 439/619
2004/0233668 A1 * 11/2004 Telfer ..... F21S 4/10 362/249.16
2008/0316742 A1 * 12/2008 Zhou ..... F21S 4/15 362/231
2009/0046461 A1 * 2/2009 Fan ..... F21V 3/02 362/242
2013/0176735 A1 * 7/2013 Kobayashi ..... F21V 29/70 362/249.02
2015/0062899 A1 * 3/2015 Yang ..... F21V 33/0052 362/249.02
2015/0354768 A1 * 12/2015 Gaumann ..... F21S 9/035 362/183

* cited by examiner

*Primary Examiner* — Christopher E Dunay

(57) ABSTRACT

A string light includes a number of light emitting units, a number of connection cables, any two of which are detachably connectable to each other, and a number of integrally-formed light covers. Each of the light emitting units is connected to two of the connection cables. The light emitting units are received in the light covers, respectively. Each of the light covers defines two through holes that allow a corresponding one of the light emitting units and ends of two of the connection cables to pass therethrough. The light covers are connected to the connection cables.

7 Claims, 8 Drawing Sheets

STRING LIGHT, CONNECTION CABLE AND LIGHT COVER

CROSS REFERENCE TO RELATED APPLICATIONS

This application claims priority on Patent Application No. 202210837729.9, which are filed in People's Republic of China on Jul. 15, 2022, which is hereby incorporated by reference herein as if set forth in its entirety.

BACKGROUND

1. Technical Field

The present disclosure generally relates to string lights, and particularly to a string light having light emitting units and cables that are detachably connected to one another.

2. Description of Related Art

String lights are widely used in decorative lighting, where they are usually hung on walls or moldings to create a desired atmosphere. Generally, a string light includes multiple light emitting elements connected in series. The power input end and power output end of each light emitting element are usually located at the same end of the light cover, which is equivalent to that the light covers are hung side by side on the connection cable. The arrangement in which the light covers are connected in parallel with the cable cannot meet the user's demand for aesthetics. Another conventional string light has light covers connected in series on the cable. The light emitting elements are integrated on the cable first, and each light emitting element is covered by two light covers that are connected to each other. A line will be formed between the two light covers where they are joined, which adversely affects the aesthetics of the light covers. However, it is not conducive to assembling of the string light when a single light cover is used for each light emitting element. Additionally, when a light emitting element is not working, a light cover is broken, or the cable between two light emitting elements is damaged, the entire string light needs to be replaced, which undoubtedly causes waste. Therefore, there is a need to provide a string light that has light covers connected in series with the cables, while maintaining the overall shape of the light covers, and facilitating the assembly, maintenance and replacement of the string light.

SUMMARY

A string light includes a number of light emitting units, a number of connection cables, any two of which are detachably connectable to each other, and a number of integrally-formed light covers. Each of the light emitting units is connected to two of the connection cables. The light emitting units are received in the light covers, respectively. Each of the light covers defines two through holes that allow a corresponding one of the light emitting units and ends of two of the connection cables to pass therethrough. The light covers are connected to the connection cables.

In one aspect, each of the connection cables includes a cable for transmitting electrical power or electrical signals, an input component connected to a first end of the cable, and an output component connected to an opposite, second end of the cable. A first of the input component and the output component is a male connector, and a second of the input component and the output component is a female connector. Two adjacent ones of the connection cables are connected to each other by the male connector and the female connector thereof.

In one aspect, each of the light emitting units includes a light emitting element, an input end and an output end that are connected to two of the connection cables. The light emitting element is arranged between and electrically connected to the input end and the output end. A first of the input end and the output end is a plug connector, and a second of the input end and the output end is a socket connector. The plug connector is connected to the female connector of a first of the connection cables, and the socket connector is connected to the male connector of a second of the connection cables.

In one aspect, the light emitting element includes a first light emitting element connected to the input end, and a second light emitting element connected to the output end. The first light emitting element is electrically connected to the second light emitting element by a wire.

In one aspect, each of the light covers includes an integrally-formed main body defining a chamber, and the two through holes are in communication with the chamber. The ends of two of the connection cables and one of the light emitting units are inserted into the chamber through the two through holes.

In one aspect, the string light further includes a number of nuts movably arranged around the connection cables, respectively. Each of the light covers further includes two hollow connection members protruding from an outer surface of the main body. The connection members are in communication with the two through holes, respectively. Each of the connection members includes external threads, and the nuts are configured to engage with the external threads of the connection members of the light covers so as to connect the connection cables to the light covers.

In one aspect, internal threads are defined in an inner surface of each of the two through holes. The input component and the output component of each of the connection cables include external threads. The external threads of the connection cables are configured to engage with the internal threads of the through holes of the light covers so as to connect the connection cables to the light covers.

In one aspect, each of the connection cables includes two mounting members adjacent to the input component and the output component, respectively. Each of the mounting members of the connection cables and the main bodies of the light covers define a threaded holes that allows screws to pass through, which connects the connection cables to the light covers.

In one aspect, a connection cable is provided to be applied in a string light. Any two of the connection cables are detachably connectable to each other. The connection cable includes a cable, an input component connected to a first end of the cable, and an output component connected to an opposite, second end of the cable. The string light includes a number of light emitting units and a number of integrally-formed light covers. The light emitting units are received in the light covers, respectively, and each of the light covers defines two through holes that allow a corresponding one of the light emitting units and ends of two of the connection cables to pass therethrough. The light covers are connected to the connection cables. A first of the input component and the output component is a male connector, and a second of the input component and the output component is a female connector. Two adjacent ones of the connection cables are connected to each other by the male connector and the female connector thereof. Each of the light emitting units includes a light emitting element, an input end and an output end that are connected to two of the connection cables. The light emitting element is arranged between and electrically connected to the input end and the output end. A first of the input end and the output end is a plug connector, and a second of the input end and the output end is a socket connector. The plug connector is connected to the female connector of a first of the connection cables, and the socket connector is connected to the male connector of a second of the connection cables.

In one aspect, a light cover is provided to be applied in a string light. The light cover includes an integrally-formed main body defining a chamber. The main body defines two through holes that include an input-end through hole in one end of the main body and in communication with the chamber, and an output-end through hole in an opposite end of the main body and in communication with the chamber. The string light includes a number of connection cables and a number of light emitting units. Any two of the connection cables are detachably connectable to each other. Each of the light emitting units is connected between two of the connection cables. The light emitting units are received in a number of the light covers. The light emitting units and ends of the connection cables are insertable into the chambers of the light covers through the input-end through holes or the output-end through holes, and the light covers are connected to the connection cables.

Embodiments of the present disclosure have the following advantages. Specifically, by having any two connection cables to be detachably connectable to each other, connection cables of different lengths can be freely connected to one another. By detachably connecting any light emitting unit between two of the connection cables, it is convenient to replace the light emitting unit with a new one. The light covers are integrally formed by injection molding, so as to maintain the integrity and aesthetics of the light covers. Through holes are defined in opposite ends of each light cover in the direction passing through the center of the light cover. The ends of two connection cables and one light emitting unit can be inserted into one light cover through the through holes of the light cover. The light is connected with the connection cables. With such configuration, it facilitates the assembly of the string light. When any connection cable or light emitting unit fails, the connection cables at opposite ends of the faulty component can be disconnected from the faulty component to replace the faulty component with a new one, so as to facilitate the maintenance of the string light and the replacement of components.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
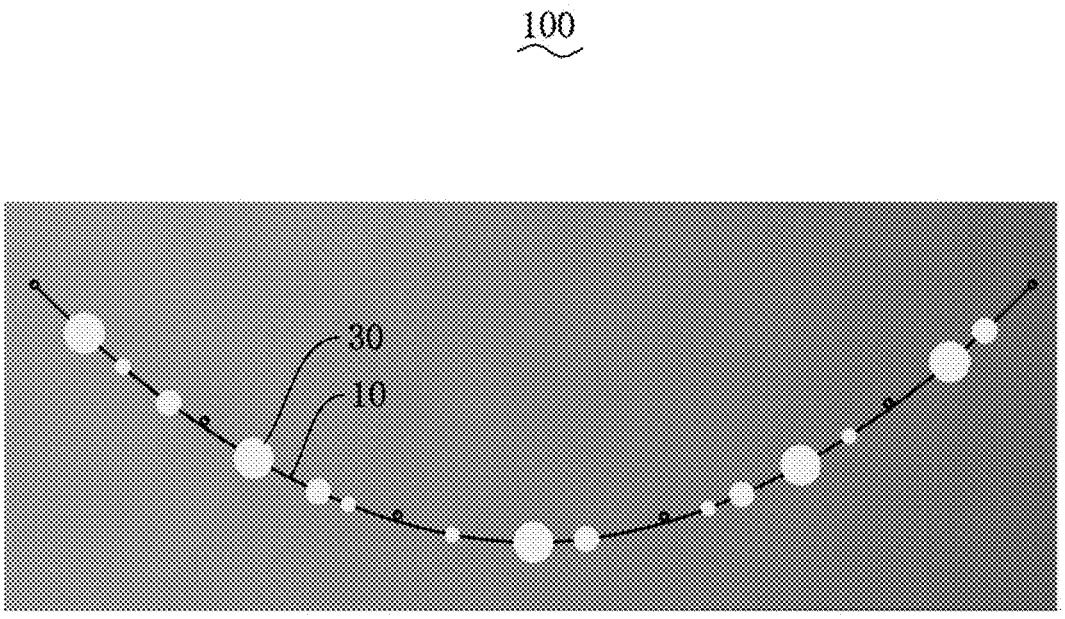
FIG. 1 is a schematic diagram of an application scenario of a string light according to one embodiment.

Reference will now be made in detail to the exemplary embodiments, examples of which are illustrated in the accompanying drawings. Wherever possible, the same reference numbers will be used throughout the drawings to refer to the same or like parts.

Although specific configurations and arrangements are discussed, it should be understood that this is done for illustrative purposes only. A person skilled in the pertinent art will recognize that other configurations and arrangements can be used without departing from the spirit and scope of the present disclosure. It will be apparent to a person skilled in the pertinent art that the present disclosure can also be employed in a variety of other applications.

It is noted that references in the specification to "one embodiment," "an embodiment," "an example embodiment," "some embodiments," "certain embodiments," etc., indicate that the embodiment described may include a particular feature, structure, or characteristic, but every embodiment may not necessarily include the particular feature, structure, or characteristic. Moreover, such phrases do not necessarily refer to the same embodiment. Further, when a particular feature, structure, or characteristic is described in connection with an embodiment, it would be within the knowledge of a person skilled in the pertinent art to effect such feature, structure, or characteristic in connection with other embodiments whether or not explicitly described.

In general, terminology may be understood at least in part from usage in context. For example, the term "one or more" as used herein, depending at least in part upon context, may be used to describe any feature, structure, or characteristic in a singular sense or may be used to describe combinations of features, structures, or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

It should be noted that when an element is described as "fastened to" or "disposed on" another element, the element may be directly on the another element, or a mediate element may also exist; when an element is described as "connected to" another element, the element may be directly connected to the another element, or a mediate element may also exist. It should be further noted that orientation terms such as left, right, upper, lower, and middle in the embodiment are only relative concepts or relative to a normal usage state of a product, and should not be considered limiting.

The terminology used in the description of the various described embodiments herein is for the purpose of describing particular embodiments only and is not intended to be limiting. It will also be understood that the term "and/or" as used herein refers to and encompasses any and all possible combinations of one or more of the associated listed items.

Figure 2:
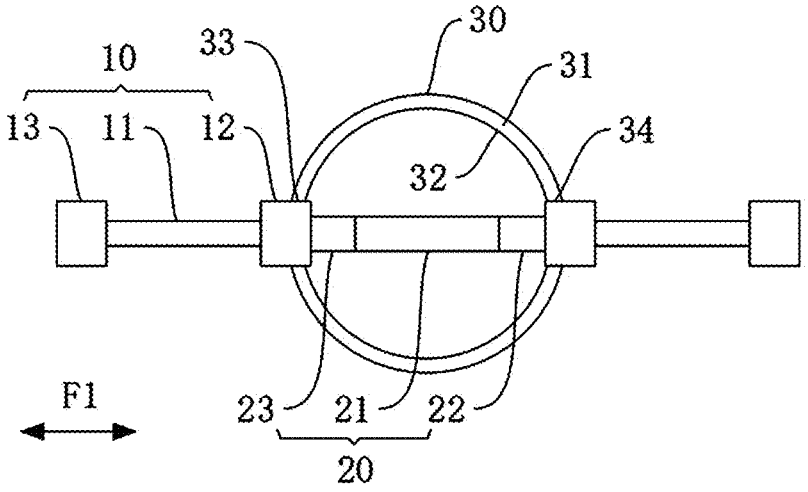
FIG. 2 is a schematic diagram showing a portion of the string light according to one embodiment.
Figure 3:
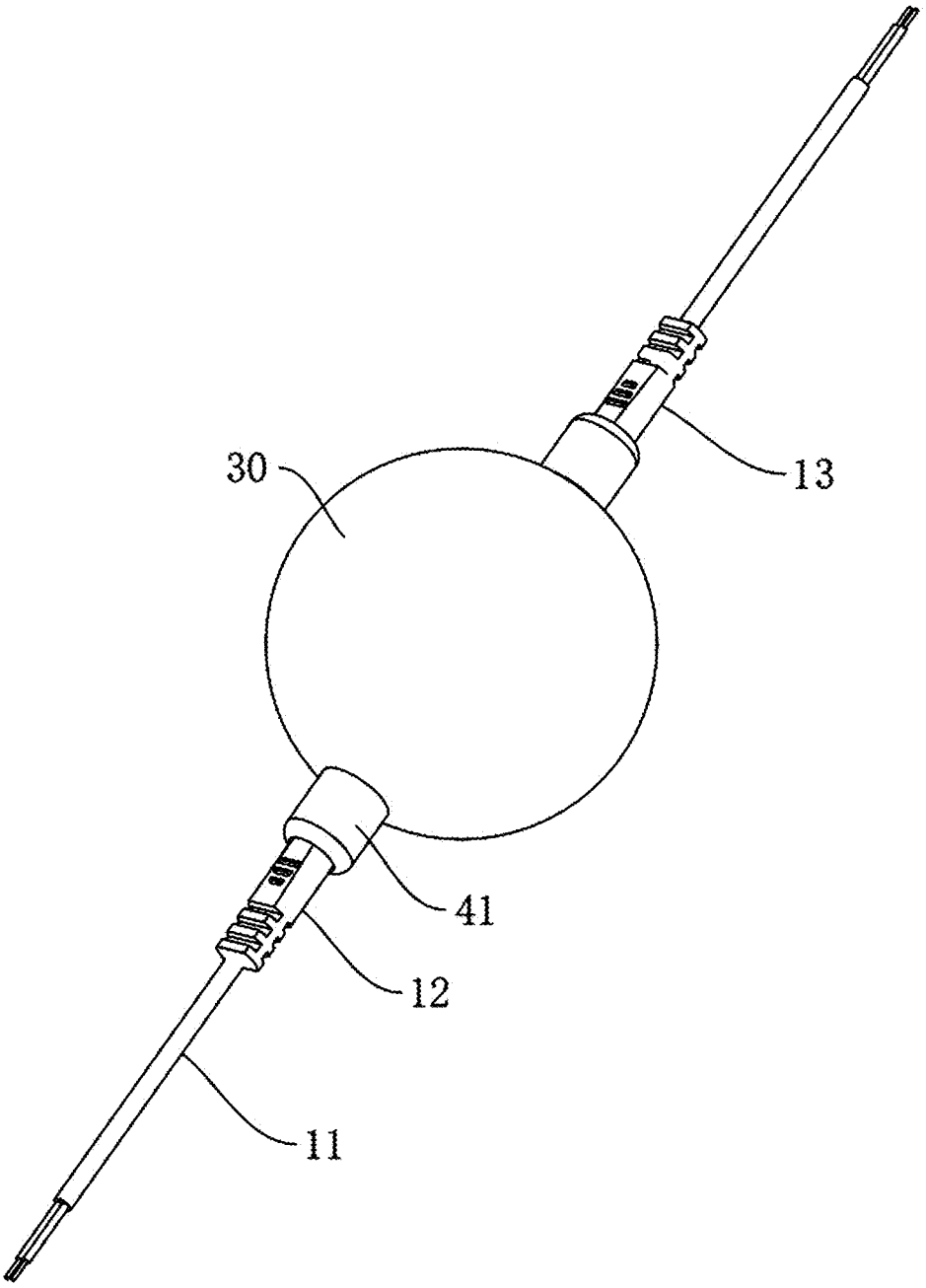
FIG. 3 is an isometric view of a portion of the string light according to one embodiment.
Figure 4:
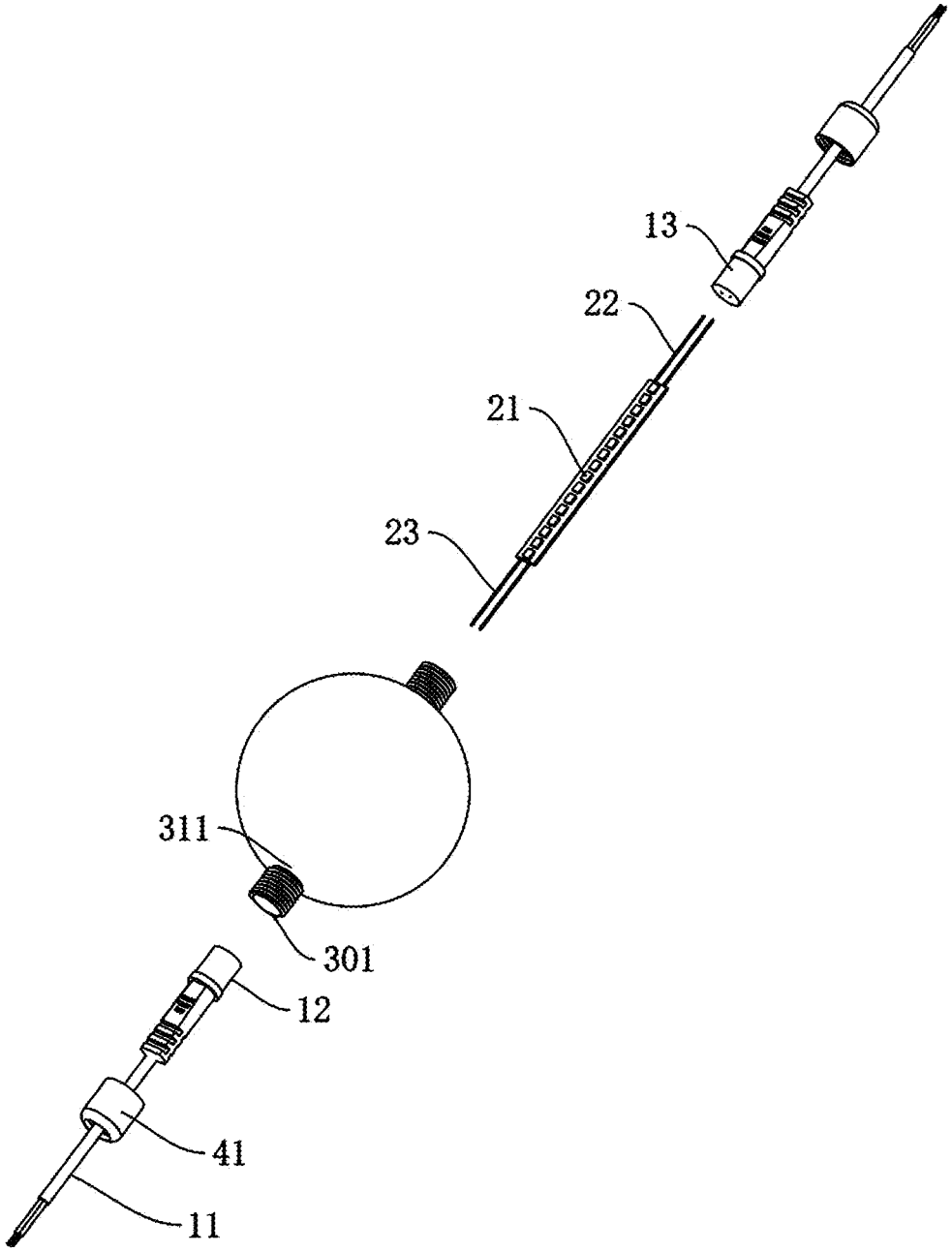
FIG. 4 is an isometric exploded view of the portion of the string light in FIG. 3.
Figure 5:
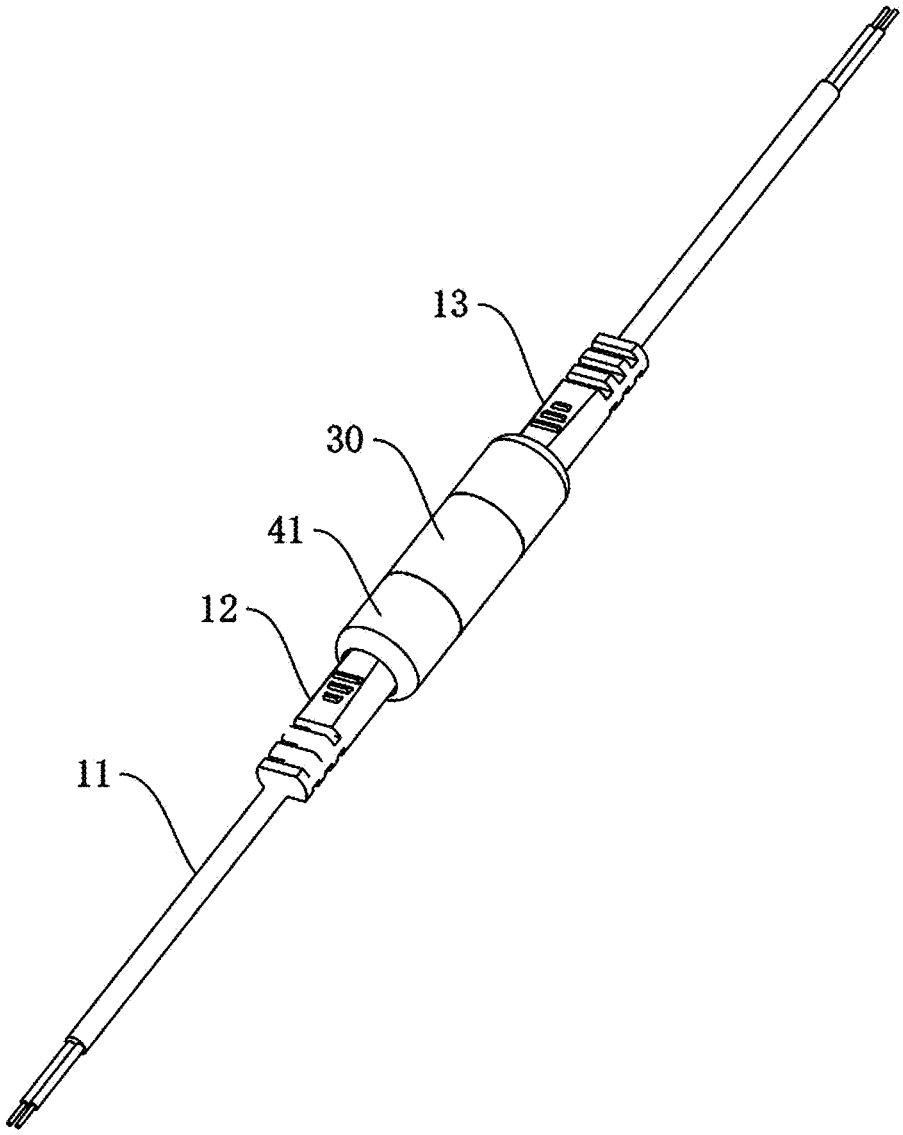
FIG. 5 is an isometric view of a portion of the string light according to another embodiment.
Figure 6:
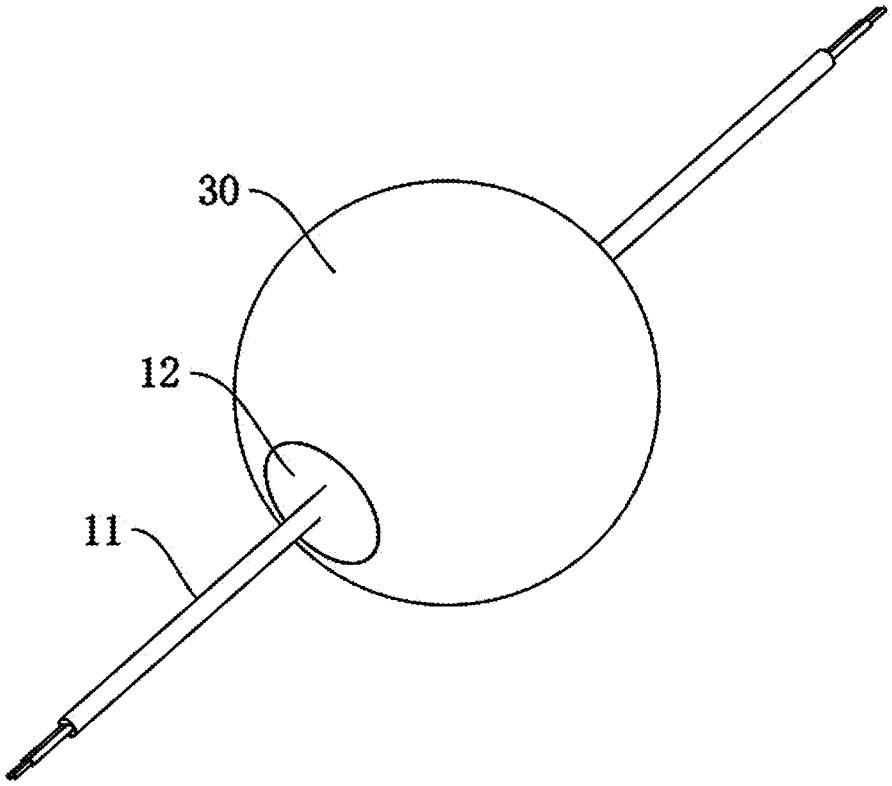
FIG. 6 is an isometric view of a portion of the string light according to yet another embodiment.
Figure 7:
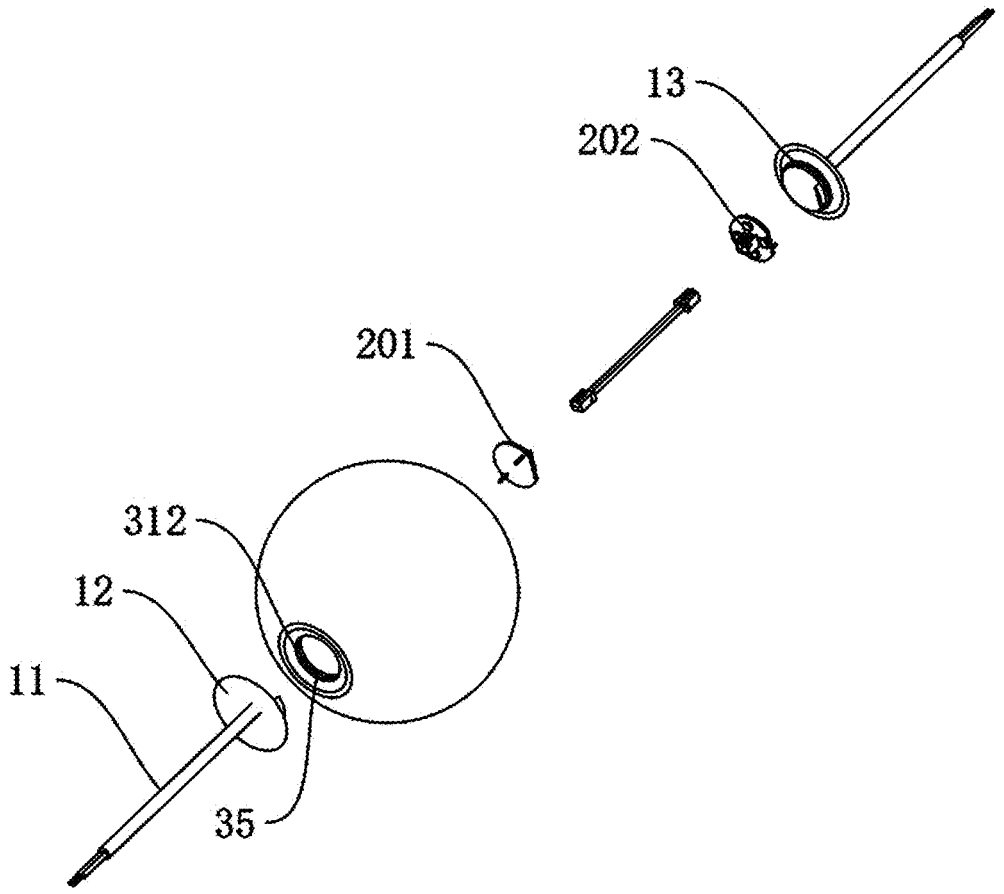
FIG. 7 is an isometric exploded view of the portion of the string light in FIG. 6.
Figure 8:
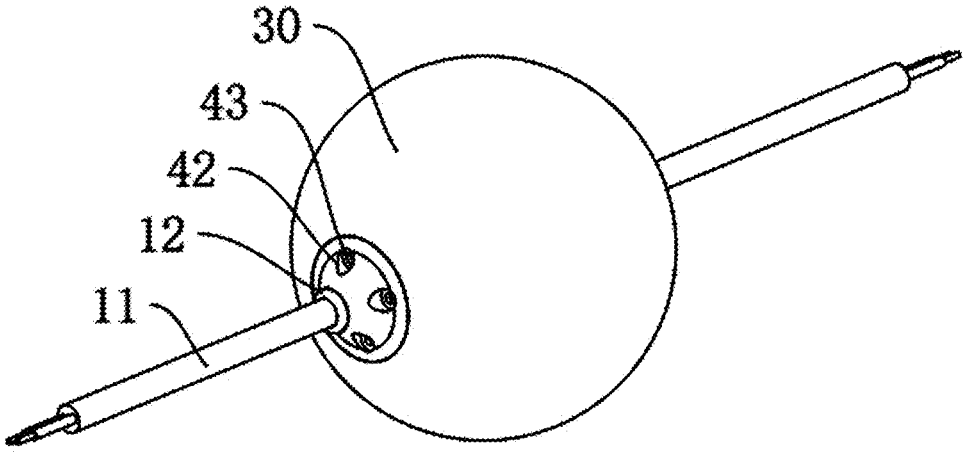
FIG. 8 is an isometric view of a portion of the string light according to yet another embodiment.

Referring to FIGS. 1-8, in one embodiment, a string light 100 includes a number of connection cables 10, a number of light emitting units 20, and a number of light covers 30.

In one embodiment, each light cover is integrally formed by injection molding, and accommodates one light emitting unit 20. Different from some conventional light covers formed by gluing two half covers together, the advantage of the light covers 30 is that there is no joining line on the surface of each light cover 30, and the integrity of the light covers 30 is maintained, which enhance the aesthetics of the light covers 30. The key point is how to conveniently assemble the light emitting units 20 into the integrally formed light covers 30.

The following description will be given by taking the assembly of one light emitting unit 20 into one light cover 30 as an example. Specifically, the direction passing through the center of the light cover 30 is denoted as the first direction F1, where the center of the light cover 30 refers to the geometric center of the light cover 30. For example, if the light cover 30 is spherical, the center of the light cover 30 is the center of a sphere. In another embodiment, if the light cover 30 is a cube, the center of the light cover 30 is the intersection of the diagonals of the cubes. In yet another embodiment, if the light cover 30 is cylindrical, the center of the light cover 30 is a midpoint on the central axis. When the light cover 30 is of other irregular shapes, the geometric center may be set according to design requirements.

Specifically, in the first direction F1, opposite ends of the light cover 30 define two through holes 35. A chamber 32 is formed during injection molding of the light cover 30, and the through holes 35 communicate with the chamber 32. One connection cable 10 and one light emitting unit 20 can be inserted into one light cover 30 through one through hole 35, and the light cover 30 is connected with the connection cable 10. That is, during assembly, the light emitting unit 20 is first inserted into the light cover 30, and two connection cables 10 are then connected to the light cover 30. By repeat the above-mentioned operations, a number of light emitting units 20 can be connected to one another through the connection cables 10 and the light covers 30, thereby forming the string light 100.

The insertion of the connection cable 10 and the light emitting unit 20 into the light cover 30 through the through hole 35 means that one end of the connecting wire 10 and the light emitting unit 20 can be inserted into the light cover 30 through the opening 35. By selecting a proper size of the through holes 35 to match the sizes of the light emitting units 20 and the connection cables 10, the ends of the connection cables 10 and the light emitting units 20 can be inserted into the light cover 30.

The connection cables 10 are used to transmit power and electrical signals, and the light emitting units 20 are electrically connected to the connection cables 10. It can also be understood that any light emitting unit 20 is electrically connected between two connection cables 10, and light covers 30 accommodate the light emitting units 20, which can protect the light emitting units 20 and improve the aesthetics of the string light 100.

In one embodiment, any two connection cables 10 can be detachably connected to each other by, for example, connectors including a male connector and a female connector. The connectors can include any proper common standard connectors, such as headphone plugs, DC plugs, audio plugs, USB plugs, video plugs, microphone plugs, charger plugs, mobile phone plugs, or any connection structure customized according to actual situations through the engagement of a male connector with a female connector to create mechanical and electrical connection.

In one embodiment, the above-mentioned detachable connection allows that any two connection cables 10 can be connected to each other by engagement of a male connector with a female connector, and that any two connection cables 10 can be disconnected from each other by disconnection of the male connector with the female connector.

In order to avoid that the entire string light 100 does not work when a certain connection cable 10 fails, any two connection cables 10 are detachably connected to each other. When one of the connection cables 10 fails, it can be removed and replaced with a new connection cable 10. As a result, it can ensure that the string light 100 can still work after the failed connection cable 10 is replaced with a new connection cable 10, thereby avoiding waste.

In order to realize a more diversified arrangement of the string light 100, by detachably connecting two connection cables 10 together, a number of short connection cables 10 can be connected to each other to form a long connection cable 10. According to the design requirements of the string light 100, the total length of the connection cables 10 between two adjacent light emitting units 20 can be adjusted, so as to realize a more diversified arrangement of the light string 100.

One light emitting unit 20 can be detachably connected to two connection cables 10, and is electrically connected to the two connection cables 10 by a male connector and a female connector. Each light emitting unit 20 and each connection cable 10 can be considered as standard parts, and any light emitting unit 20 can be detachably connected to any two connection cables 10 by, for example, a male connector and a female connector. The male and female connectors on each light emitting unit 20 can engaged with the female and male connectors on each connection cable 10. As a result, not only can any two connection cables 10 be connected to each other through the engagement of a male connector with a female connector, but also any light emitting unit 20 and any connection cable 10 can be connected to each other through the engagement of a male connector with a female connector. According to actual needs, any two light emitting units 20 can also be connected to each other through the engagement of a male connector with a female connector.

In order to avoid that the entire string light 100 does not work when a certain light emitting unit 20 fails, each light emitting unit 20 is detachably connected between two connection cables 10. When one of the light emitting unit 20 fails, it can be removed and replaced with a new light emitting unit 20. As a result, it can ensure that the string light 100 can still work after the failed light emitting unit 20 is replaced with a new light emitting unit 20, thereby avoiding waste.

In one embodiment, each of the connection cables 10 includes a cable 11, an input component 12, and an output component 13. The cable 11 is to transmit electrical power and/or electrical signals. The input component 12 is a terminal connected to a first end of the cable 11, and the output component 13 is a terminal connected to an opposite, second end of the cable 11. One of the input component 12 and the output component 13 is a male connector, and the other is a female connector. Two adjacent ones of the connection cables 10 can be connected to each other by the male connector and the female connector thereof.

When connecting any two connection cables 10, the male connector of one of the connection cables 10 is connected to the female connector of the other one of the connection cables 10, or the female connector of the one of the connection cables 10 is connected to the male connector of the other one of the connection cables 10.

In one embodiment, each of the light emitting units 20 includes a light emitting element 21, an input end 22 and an output end 23 that are connected to two of the connection cables 10.

The light emitting element 21 is a light source that emits visible light after receiving electrical power. For example, the light emitting element 21 can be a conventional incandescent lamp, a fluorescent lamp, an energy-saving lamp, a light emitting diode (LED). In one embodiment, the light emitting element 21 includes a circuit board and an LED chip integrated on the circuit board. The connection cables 10 transmit electrical power and signals to the light emitting element 21. The signals are used to control the brightness and color of visible light emitted by the LED chip.

When any light emitting unit 20 is connected to any two connection cables 10, the input end 22 of the light emitting unit 20 is connected to the output component 13 of one of the connection cables 10, and the light source output end 23 of the light emitting unit 20 is connected to the input component 12 of the other connection cable 10. The light emitting element 21 is arranged between and electrically connected to the input end 22 and the output end 23, which allows electrical power and electrical signals to be transmitted to the light emitting element 21 through the connection cables 10.

In one embodiment, one of the input end 22 and the output end 23 is a plug connector, and the other of the input end 22 and the output end 23 is a socket connector. When connecting one light emitting unit 20 with any two connection cables 10, the plug connector of the light emitting unit 20 is connected to the female connector of one of the connection cables 10, and the socket connector of the light emitting unit 20 is connected to the male connector of the other of the connection cables 10.

In one embodiment, the light emitting unit 20 may include a number of LED chips. In order to enable the LED chip integrated on the circuit board to illuminate a large area, the LED chips are arranged on the front and back sides of the circuit board, so as to illuminate a large area in two opposite directions. In another embodiment, the light emitting unit 20 may include a number of panels, and the LED chips are arranged on the panels to emit light from multiple faces at different angles to illuminate a large area.

In one embodiment, in order to enable the light emitting element 21 to fully illuminate the light cover 30 without dead angle, a configuration of two light sources 21 facing each other is adopted. Specifically, the light emitting element 21 includes a first light emitting element 201 and a second light emitting element 202.

The first light emitting element 201 is connected to the input end 12 of a connection cable 10, and is inserted into the light cover 30 through the through hole 35 at one end of the light cover 30. The second light emitting element 202 is connected to the output end 13 of another connection cable 10, and is inserted into the light cover 30 through the through hole 35 at the opposite end of the light cover 30. The second light emitting element 202 is connected with the first light emitting element 201. As a result, the first light emitting element 201 illuminates from the through hole 35 at one end of the light cover 30 toward the through hole 35 at the other end of the light cover 30, and the second light emitting element 202 illuminates from the through hole 35 at the other end of the light cover 30 toward the through hole 35 at the one end of the light cover 30, forming the configuration in which the two light emitting elements 21 are opposite to each other at opposite ends of the light cover 30.

In one embodiment, the light cover 30 and the connection cables 10 are fixed to each other by threaded connection. In order to avoid damage to the first light emitting element 201 and the second light emitting element 202 due to the torque generated during the rotation of the connection cables 10 relative to the light cover 30, the first light emitting element 201 and the second light emitting element 202 can be connected to each other by a wire, and the torque acting on the wire will not affect the performance of the light emitting unit 20. In the embodiment, the wire can be in the form of a connection cable 10. The input end 22 of the first light emitting element 201 is connected to the input component 12 of one connection cable 10. The output end 22 of the first light emitting element 201 is connected to the input component 12 of the wire, and the output component of the wire is connected to the input end 22 of the second emitting element 202. The output end of the second light emitting element 202 is connected to the input end 12 of another connection cable 10.

In one embodiment, each of the light covers 30 include an integrally-formed main body 31. The main body 31 can be integrally formed by injection molding. Different from some conventional light covers formed by gluing two half covers together, there is no joining line on the surface of each light cover 30, and the integrity of the light covers 30 is maintained, which enhance the aesthetics of the light covers 30. The main body 31 defines a chamber 32. The through holes 35 penetrate through the main body 31 along the first direction F1, and are in communication with the chamber 32. The ends of two of the connection cables 10 and one light emitting unit 20 are inserted into the chamber 32 through the two through holes 35.

In one embodiment, one of the two through holes 35 is referred to as input-end through hole 33, and the other is referred to as output-end through hole 34.

In the first direction F1, the input-end through hole 33 is located at one end of the main body 31 and is in communication with the chamber 32. The output-end through hole 34 is located at the opposite end of the main body 31 and is in communication with the chamber 32. When any two connection cables 10 extend into the chamber 32, the input component 12 of one of the connection cables 10 is inserted into the output-end opening 34, and the output component 13 of the other connection cable 10 is inserted into the input-end through hole 33. When any light emitting unit 20 is inserted into the light cover 30, the light emitting unit 20 is first connected with one connection cable 10, and then inserted into the light cover 30 through the input-end through hole 33 or the output-end through hole 34 and is connected with the other connection cable 10.

In one embodiment, for ease of installation of the string light 100, and flexibility in selecting male and female connectors, the string light further includes a number of nuts 41 movably arranged around the connection cables 10, respectively. Each of the light covers 30 further comprises two hollow connection members 301.

The connection members 301 protrude from an outer surface 311 of the main body 31 in the first direction F1. The connection members 301 are in communication with the two through holes 35, respectively. Each of the connection members 301 has external threads on its outer lateral surface. The nuts 41 are to engage with the external threads of the connection members 301 of the light covers 30 so as to connect the connection cables 10 to the light covers 30.

During the assembly process of the light string 100, each light emitting unit 20 can be first connected to a corresponding connection cable 10, and then the end of each light emitting unit 20 that is not connected to the connection cable 10 can be inserted into the chamber 32 of one light cover 30 through one through hole 35. Then, one nut 41 of the connection cable 10 is moved toward a corresponding connection member 30 and then turned so that the nut 41 can engage with the external threads on one connection member 301, thereby connecting the connection cable 10 to the light cover 30. Then, the light emitting unit 20 in the light cover 30 is then connected with another connection cable 10, and one nut 41 on the connection cable 10 is moved and turned so as to engage with the external threads on another connection member 301.

In the embodiment, since the nuts 41 are movably arranged around the connection cables 10, torque will not be transmitted to the light emitting units 20 on the connection cables 10 during the rotation of the nuts 41 relative to the connection members 301. As a result, the input components 12 and the output components 13 of the connection cables 10, and the input ends 22 and the output ends 22 of the light emitting units 20 may adopt any proper connectors.

In one embodiment, in order to facilitate the assembly of the string light 100, inner threads are formed in the inner surface 312 of each through hole 35 of the light covers 30, and the input component 12 and the output component 13 of each of the connection cables 10 have external threads. The external threads of the connection cables 10 are to engage with the internal threads of the through holes 35 of the light covers 30 so as to connect the connection cables 10 to the light covers 30.

During the assembly process of the light string 100, each light emitting unit 20 can be first connected to a corresponding connection cable 10, and then the end of each light emitting unit 20 that is not connected to the connection cable 10 can be inserted into the chamber 32 of one light cover 30 through one through hole 35. The connection cable 10 or the light cover 30 can then rotated so as to allow the external threads on the connection cable 10 to engage with the inner threads in inner surface of one through hole 35, thereby connecting the connection cable 10 to the light cover 30. After that, one end of another connection cable 10 is inserted into the light cover 30, and connected with the light emitting unit 20.

In the embodiment, during rotation of the connection cables 10 relative to the light covers 30, the light emitting units 20 will be rotated and torque will be acted upon the light emitting units 20. After the connection cable 10 at one end of one light emitting unit 20 is fixed to one light cover 30, the connection cable 10 at the other end of the light emitting unit 20 cannot realize the plug-in action while being rotated. Therefore, the input components 12 and the output components 13 of the connection cables 10, and the input ends 22 and the output ends 22 of the light emitting units 20 need to be rotatable single-column joints, such as TRS connectors, RCA connectors, and BNC connectors, and the like.

In one embodiment, in order to facilitate the assembly of the string light 100 and improve the fixing reliability of the light covers 30 and the connection cables 10, two mounting members 42 are provided on the sides of the input component 12 and the output component 13 adjacent to the main body 31, and threaded holes 43 are formed in the mounting members 42 and the main body 31. The threaded holes 43 allow screws to pass therethrough, which connects the connection cables 10 to the light covers 30. Since the light covers 30 and the connection cables 10 are fixed to each other by a reliable screw connection, the conductors inside the light covers 30 are effectively prevented from being exposed to the outside of the light covers 30. Therefore, the light emitting units 20 can work in a higher voltage working environment, which not only ensures the safety of the string light 100, but also can use a filament and light distribution scheme suitable for higher voltages to be applied to the string light 100, thereby improving the design diversity of the string light 100.

In one embodiment, a connection cable 10 is provided to be applied in the string light 100. Any two of the connection cables 10 are detachably connectable to each other. The connection cable 10 includes the cable 11, the input component 12 connected to a first end of the cable 11, and the output component 13 connected to an opposite, second end of the cable 11. The cable is to transmit electrical power and electrical signals.

The string light 100 includes a number of light emitting units 20 and a number of ends integrally-formed light covers 30. The light emitting units 20 are received in the light covers 30, respectively. Each light emitting unit 20 is detachably connected to two of the connection cables 20. The direction passing through the center of the light cover 30 is denoted as the first direction F1. In the first direction F1, opposite ends of each light cover 30 define two through holes 35. The light emitting units 20 are received in the chambers of the light covers 30. One of the light emitting units 20 and ends of two of the connection cables 10 can be inserted into each light cover 30 through the two through holes thereof. The light covers 30 are connected to the connection cables 10. One of the input component 12 and the output component 13 is a male connector, and the other of the input component 12 and the output component 13 is a female connector. When two connection cables 10 are connected, the male connector of one of the connection cables 10 is connected to the female connector of the other one of the connection cables 10, or the female connector of the one of the connection cables 10 is connected to the male connector of the other one of the connection cables 10.

Each of the light emitting units 20 include the light emitting element 21 that can emit visible light, the input end 22 connected to the output terminal 13 of one connection cable 10, and the output end 23 connected to the input end 12 of another connection cable 10. The light emitting element 21 is arranged between and electrically connected to the input end 22 and the output end 23. One of the input end 22 and the output end 23 is a plug connector, and the other of the input end 22 and the output end 23 is socket connector. When one light emitting unit 20 is connected to two connection cables 10, the plug connector 20 of the light emitting unit 20 is connected to the female connector of one of the two connection cables 10, and the socket connector of the light emitting unit 20 is connected to the male connector of the other of the two connection cables 10.

In one embodiment, a light cover 30 is provided. The light cover 30 is applied in the string light 100. The light cover 30 includes the integrally-formed main body 31 defining the chamber 32. The main body 31 defines the two through holes 35. The direction passing through the center of the light cover 30 is denoted as the first direction F1. The through holes 35 penetrate through the main body 31 along the first direction F1 and are located at opposite ends of the light cover 30.

The two through holes 35 include an input-end through hole 33 and an output-end through hole 34. In the first direction F1, the input-end through hole 33 is located in one end of the main body 31 and in communication with the chamber 32. The output-end through hole 34 is located in an opposite end of the main body 31 and in communication with the chamber 32.

The string light 100 includes the connection cables 10 and the light emitting units 20. Any two of the connection cables 10 are detachably connectable to each other. The light emitting units 20 are received in the chambers 32 of the light covers 30. Each of the light emitting units 20 is detachably connected between two of the connection cables 10. The light emitting units 20 and ends of the connection cables 10 are insertable into the chambers 32 of the light covers 30 through the input-end through holes 33 or the output-end through holes 34. The light covers 30 are connected to the connection cables 10.

By having any two connection cables 10 to be detachably connectable to each other, connection cables 10 of different lengths can be freely connected to one another. By detachably connecting any light emitting unit 20 between two of the connection cables 10, it is convenient to replace the light emitting unit 20 with a new one. The light covers 30 are integrally formed by injection molding, so as to maintain the integrity and aesthetics of the light covers 30. Through holes 35 are defined in opposite ends of each light cover 30 in the direction passing through the center of the light cover 30. The ends of two connection cables 10 and one light emitting unit 20 can be inserted into one light cover 30 through the through holes 35 of the light cover 30. The light 30 is connected with the connection cables 10. With such configuration, it facilitates the assembly of the string light 100. When any connection cable 10 or light emitting unit 20 fails, the connection cables 10 at opposite ends of the faulty component can be disconnected from the faulty component to replace the faulty component with a new one, so as to facilitate the maintenance of the string light 100 and the replacement of components.

The embodiments above are only illustrative for the technical solutions of the present disclosure, rather than limiting the present disclosure. Although the present disclosure is described in detail with reference to the above embodiments, those of ordinary skill in the art should understand that they still can modify the technical solutions described in the foregoing various embodiments, or make equivalent substitutions on partial technical features; however, these modifications or substitutions do not make the nature of the corresponding technical solution depart from the spirit and scope of technical solutions of various embodiments of the present disclosure, and all should be included within the protection scope of the present disclosure.

What is claimed is:

1. A string light comprising:

a plurality of light emitting units;

a plurality of connection cables, any two of the connection cables detachably connectable to each other, wherein each of the light emitting units is connected to two of the plurality of connection cables; and a plurality of integrally-formed light covers, the light emitting units received in the light covers, respectively, each of the light covers defining two through holes that allow a corresponding one of the light emitting units and ends of two of the connection cables to pass therethrough, and the light covers connected to the connection cables;

wherein each of the connection cables comprises a cable for transmitting electrical power or electrical signals, an input component connected to a first end of the cable, and an output component connected to an opposite, second end of the cable, a first of the input component and the output component is a male connector, and a second of the input component and the output component is a female connector, and two adjacent ones of the connection cables are connected to each other by the male connector and the female connector thereof;

wherein each of the light emitting units comprises a light emitting element, an input end and an output end that are connected to two of the connection cables, the light emitting element is arranged between and electrically connected to the input end and the output end, a first of the input end and the output end is a plug connector, a second of the input end and the output end is a socket connector, the plug connector is connected to the female connector of a first of the connection cables, and the socket connector is connected to the male connector of a second of the connection cables; and wherein the light emitting element comprises a first light emitting element connected to the input end, and a second light emitting element connected to the output end, and the first light emitting element is electrically connected to the second light emitting element by a wire, the first light emitting element is configured to emit light toward one of the through holes of a corresponding one of the light covers, and the second light emitting element is configured to emit light toward the other one of the through holes of the corresponding one of the light covers.

2. The string light of claim 1, wherein each of the light covers comprises an integrally-formed main body defining a chamber, the two through holes are in communication with the chamber, the ends of two of the connection cables and one of the light emitting units are inserted into the chamber through the two through holes.

3. The string light of claim 2, further comprising a plurality of nuts movably arranged around the connection cables, respectively, wherein each of the light covers further comprises two hollow connection members protruding from an outer surface of the main body, the connection members are in communication with the two through holes, respectively, each of the connection members comprises external threads, the nuts are configured to engage with the external threads of the connection members of the light covers so as to connect the connection cables to the light covers.

4. The string light of claim 2, wherein internal threads are defined in an inner surface of each of the two through holes, the input component and the output component of each of the connection cables comprise external threads, the external threads of the connection cables are configured to engage with the internal threads of the through holes of the light covers so as to connect the connection cables to the light covers.

5. The string light of claim 2, wherein each of the connection cables comprises two mounting members adjacent to the input component and the output component, respectively, each of the mounting members of the connection cables and the main bodies of the light covers define a threaded holes that allows screws to pass through, which connects the connection cables to the light covers.

6. A connection cable applied in a string light, any two of the connection cables detachably connectable to each other, the connection cable comprising:

a cable;

an input component connected to a first end of the cable; and an output component connected to an opposite, second end of the cable;

wherein the string light comprises a plurality of light emitting units, and a plurality of integrally-formed light covers, the light emitting units are received in the light covers, respectively, each of the light covers defines two through holes allow a corresponding one of the light emitting units and ends of two of the connection cables to pass therethrough, the light covers are connected to the connection cables;

wherein a first of the input component and the output component is a male connector, and a second of the input component and the output component is a female connector, and two adjacent ones of the connection cables are connected to each other by the male connector and the female connector thereof;

wherein each of the light emitting units comprises a light emitting element, an input end and an output end that are connected to two of the connection cables, the light emitting element is arranged between and electrically connected to the input end and the output end, a first of the input end and the output end is a plug connector, a second of the input end and the output end is a socket connector, the plug connector is connected to the female connector of a first of the connection cables, and the socket connector is connected to the male connector of a second of the connection cables;

wherein the light emitting element comprises a first light emitting element connected to the input end, and a second light emitting element connected to the output end, and the first light emitting element is electrically connected to the second light emitting element by a wire, the first light emitting element is configured to emit light toward one of the through holes of a corresponding one of the light covers, and the second light emitting element is configured to emit light toward the other one of the through holes of the corresponding one of the light covers.

7. A light cover applied in a string light, the light cover comprising:

an integrally-formed main body defining a chamber, the main body defining two through holes that comprise an input-end through hole in one end of the main body and in communication with the chamber, and an output-end through hole in an opposite end of the main body and in communication with the chamber;

wherein the string light comprises a plurality of connection cables and a plurality of light emitting units, any two of the connection cables are detachably connectable to each other, each of the light emitting units is connected between two of the connection cables, the light emitting units are received in a plurality of the light covers, the light emitting units and ends of the connection cables are insertable into the chambers of the light covers through the input-end through holes or the output-end through holes, and the light covers are connected to the connection cables;

wherein each of the connection cables comprises a cable for transmitting electrical power or electrical signals, an input component connected to a first end of the cable, and an output component connected to an opposite, second end of the cable, a first of the input component and the output component is a male connector, and a second of the input component and the output component is a female connector, and two adjacent ones of the connection cables are connected to each other by the male connector and the female connector thereof;

wherein each of the light emitting units comprises a light emitting element, an input end and an output end that are connected to two of the connection cables, the light emitting element is arranged between and electrically connected to the input end and the output end, a first of the input end and the output end is a plug connector, a second of the input end and the output end is a socket connector, the plug connector is connected to the female connector of a first of the connection cables, and the socket connector is connected to the male connector of a second of the connection cables; and wherein the light emitting element comprises a first light emitting element connected to the input end, and a second light emitting element connected to the output end, and the first light emitting element is electrically connected to the second light emitting element by a wire, the first light emitting element is configured to emit light toward one of the through holes of a corresponding one of the light covers, and the second light emitting element is configured to emit light toward the other one of the through holes of the corresponding one of the light covers.

* * * * *